US005258252A

United States Patent [19]

Sakai et al.

[11] Patent Number: 5,258,252

[45] Date of Patent: Nov. 2, 1993

[54] IMAGE-BEARING MEMBER HAVING A SURFACE LAYER OF A HIGH-MELTING POINT POLYESTER RESIN AND CURED RESIN

[75] Inventors: Kiyoshi Sakai, Chofu; Naoto Fujimura, Yokohama; Seikoh Nakano, Yokkaichi, all of Japan

[73] Assignees: Canon Kabushiki Kaisha; Mitsubishi Petrochemical Co., Ltd., Tokyo, Japan

[21] Appl. No.: 574,048

[22] Filed: Aug. 29, 1990

[30] Foreign Application Priority Data

| | | | |
|---|---|---|---|
| Sep. 1, 1989 | [JP] | Japan | 1-225046 |
| Sep. 1, 1989 | [JP] | Japan | 1-225047 |
| Dec. 28, 1989 | [JP] | Japan | 1-338296 |
| Dec. 28, 1989 | [JP] | Japan | 1-338297 |
| Jul. 30, 1990 | [JP] | Japan | 2-199006 |
| Jul. 30, 1990 | [JP] | Japan | 2-199007 |

[51] Int. Cl.[5] ..... G03G 5/14

[52] U.S. Cl. ..... 430/66; 430/96; 358/300

[58] Field of Search ..... 430/60, 66, 67, 96; 358/300

[56] References Cited

U.S. PATENT DOCUMENTS

| | | | |
|---|---|---|---|
| 4,275,135 | 6/1981 | Tomonaga | 430/95 |
| 4,424,267 | 1/1984 | Kondo et al. | 430/126 |
| 4,658,756 | 4/1987 | Ito et al. | 118/652 |
| 4,740,439 | 4/1988 | Tachikawa et al. | 430/54 |
| 4,985,330 | 1/1991 | Tsuchiya et al. | 430/130 |

FOREIGN PATENT DOCUMENTS

| | | |
|---|---|---|
| 207324 | 1/1987 | European Pat. Off. . |
| 2931279 | 4/1980 | Fed. Rep. of Germany . |
| 3029837 | 2/1981 | Fed. Rep. of Germany . |

OTHER PUBLICATIONS

Patent Abstracts of Japan, vol. 6, No. 162 (P-137) [1040], Aug. 25, 1982.

Patent Abstracts of Japan, vol. 8, No. 183 (P-296) [1620], Aug. 23, 1984.

Patent Abstracts of Japan, vol. 11, No. 211 (P-594) [2658], Jul. 9, 1987.

Patent Abstracts of Japan, vol. 12, No. 468 (P-797) [3315], Dec. 18, 1988.

*Primary Examiner*—John Goodrow

*Attorney, Agent, or Firm*—Fitzpatrick, Cella, Harper & Scinto

[57] ABSTRACT

An image-bearing member suitable for carrying an electrostatic image and/or a toner image is formed by forming a surface layer on a substrate or a photosensitive layer. The surface layer comprises a high-melting point polyester resin shows a good dispersibility of the cured resin to provide to provide a durable layer in combination with the cured resin, whereby the surface layer provides an image-bearing surface suitable for electrophotography. The surface layer may be a protective layer or a photoconductive layer when it constitutes a photosensitive member.

24 Claims, 3 Drawing Sheets

IMAGE-BEARING MEMBER HAVING A SURFACE LAYER OF A HIGH-MELTING POINT POLYESTER RESIN AND CURED RESIN

FIELD OF THE INVENTION AND RELATED ART

The present invention relates to an image-bearing member for carrying an electrostatic image and/or a toner image, more particularly to such an image-bearing member having an excellent durability and an apparatus including the image-bearing member.

The image-bearing member for carrying an electrostatic image and/or a toner image may include a photosensitive member for electrophotography and other image-bearing members inclusive of, e.g., an intermediate transfer member for a color copying machine requiring multiple times of transfer and an electrostatic recording member.

The photosensitive member for electrophotography may take various forms so as to attain desired characteristics or depending on the kinds of electrophotographic processes applied thereto. Representative photosensitive members for electrophotography may include one comprising a photoconductive layer formed on a support and one further including a surface protective layer thereon which have been widely used. The photosensitive member comprising a support and a photoconductive layer may be used for image formation by the most popular electrophotographic process including charging, imagewise exposure, development and further transfer as desired. As for the photosensitive member provided with a protective layer, such a protective layer may be provided for the purpose of, e.g., protecting the photoconductive layer, improving the mechanical strength of the photosensitive member, improving the dark decay characteristic, or providing a characteristic suited for a certain electrophotographic process, an example of which may include a system wherein a charge is injected from the support side at the time of charging to move the charge to between the protective layer and the photoconductive layer. In a representative of the system, an electrostatic image is formed through primary charging, secondary charging of a polarity opposite to the primary charging or AC charge removal and imagewise exposure, and whole-area exposure as disclosed in Japanese Laid-Open Patent Publications (KOKOKU) Sho. 42-23910 and Sho. 43-24748. In the above system, the imagewise exposure may be effected either before or after the secondary charging or AC charge removal, and the whole-area exposure can be omitted.

Another system is disclosed in U.S. Pat. No. 3,041,167.

An electrostatic image is formed on an electrophotographic photosensitive member by application of a prescribed electrophotographic process, and the electrostatic image is visualized by development.

Some other representative image forming processes are described below.

(1) In order to improve the repetitive usability of an electrophotographic photosensitive member, an electrostatic image formed on the electrophotographic photosensitive member is transferred to another image-bearing member for development, and the resultant toner image is transferred to a recording member. (2) In another electrophotographic process involving forming an electrostatic image on another image-bearing member corresponding to an electrostatic image formed on an electrophotographic photosensitive member, an electrostatic image is formed on an electrophotographic photosensitive member in the form of a screen having a large number of minute openings through a prescribed electrophotographic process, a corona charging treatment is applied to another image-bearing member by the medium of the electrostatic image to modulate the corona ion stream thereby forming an electrostatic image on the above-mentioned another image-bearing member, and the electrostatic image is developed with a toner and transferred to a recording member to form a final image. (3) According to another electrophotographic process, a toner image formed on an electrophotographic photosensitive member or another image-bearing member is not directly transferred to a recording member but is once transferred to still another image-bearing member, and the toner image is then transferred to a recording member to be fixed thereon. This process is particularly effective for production of color images and high-speed copying. The recording member may ordinarily be a flexible material, such as paper or film. Accordingly, rather than transferring three color images to a recording member with precise positional alignment, a more accurately aligned color image can be formed if three color images are transferred onto an image-bearing member composed of a material substantially free from deformation and then transferred to a recording member at a time. Further, the transfer of a toner image to a recording member by the medium of an image-bearing member is also effective for high-speed copying. (4) In another process, an electric signal is applied to a multi-stylus electrode to form an electrostatic image on an image-bearing member corresponding to the electric signal, and the electrostatic image is developed to provide an image.

The image-bearing members used in electrostatic image-forming process like those of (1)–(4) above do not require a photoconductive layer.

Thus, image-bearing members on which electrostatic images or toner images are formed may comprise various members which may generally have an insulating layer as the surface layer, including as a representative example an electrophotographic photosensitive member having a surface layer which may be a protective layer or a photoconductive layer.

While an image-bearing member is required to show electrical properties depending on a recording process applied thereto, the durability of the image-bearing member is another important property. The durability is a property required for repetitively using the image-bearing member.

More specifically, an image-bearing member is of course required to show prescribed sensitivity, electrical property and also photographic property. Particularly, the surface of a photosensitive member for repetitive use is directly subjected to electrical and mechanical forces, such as those for corona charging, toner development, transfer to paper, and cleaning, so that the image-bearing member is required of a durability against such forces. More specifically, the image-bearing member is required to show a durability against degradation with ozone or NOx generated at the time of corona charging so as not to cause a decrease in sensitivity, a potential decrease or an increase in remanent potential and also a durability against surface abrasion or occurrences of mars or scratches.

Cleaning performance is another important factor, and a decrease in abrasion resistance is essential for improving the cleaning performance.

The surface of an image-bearing member is principally composed of a resin, a photoconductive material, etc., so that the property of the resin is particularly important and a resin satisfying the above-mentioned various properties has been desired. Recently, polycarbonate resin has been used as a binder for a surface layer as a resin satisfying such properties.

More specifically, polycarbonate resin has provided a durability of $5\times10^4$–$10\times10^4$ sheets increased from a durability of several thousand to $10^4$ sheets attained by an acrylic resin used so far. This is however less than a durability of $30\times10^4$–$100\times10^4$ sheets attained by an inorganic photosensitive member of Se or a-Si (amorphous Si).

Therefore, a large number of proposals have been made of adding conventional resins or fluorine-containing resins to form a protective layer, which is however accompanied with difficulties such as an increase in remanent potential (Vr) and a lowering in sensitivity during a continuous use due to the provision of such a layer through which a charge is not moved in the photoconductive layer structure. These difficulties can be alleviated if the protective layer thickness is decreased to, e.g., 2–3 microns or less, but this has resulted in a large degree of wearing in a continuous use, i.e., a failure of improvement in durability, when the conventional resin is used.

Further, in case where a protective layer of a resin containing polytetrafluoroethylene (hereinafter, sometimes abbreviated as "PTFE") is used, it is necessary to use a soft resin in order to utilize good cleaning characteristic of PTFE. This is required to abrade the surface little by little during a continuous use of the photosensitive member so as to expose fresh PTFE, and thus a hard binder fails to exhibit the effect of PTFE. In the case where a soft binder is used, the durability of the protective layer is increased due to the effect of PTFE but scratches due to rubbing and cracking (or peeling) of the layer due to impact are liable to occur because the protective layer is rather soft. Further, when the image-bearing member contacts leading edges or trailing edges of transfer paper, the contact portion of the image-bearing member is liable to be damaged to result in image defects, such as black streaks. The protective layer also involves quite the same problems of increase in remanent potential and decrease in sensitivity during a continuous use as ordinary protective layers.

It is conceivable to use a resin with a high hardness in order to improve the wear or abrasion resistance, however, such a hard resin is liable to have a large friction coefficient which is much larger than that of polycarbonate resin, so that it is difficult to attain a good cleaning characteristic.

SUMMARY OF THE INVENTION

An object of the present invention is to provide an image-bearing member having a remarkably improved durability characteristic as well as a stable potential characteristic.

Another object of the present invention is to provide a process for producing such an image-bearing member.

A further object of the present invention is to provide an apparatus including such an image-bearing member.

According to the present invention, there is provided an image-bearing member, having a surface layer comprising a high-melting point polyester resin and a cured resin.

According to another aspect of the present invention, there is provided a process for producing an image-bearing member having a surface layer, comprising: forming the surface layer by application of a coating liquid comprising a high-melting point polyester resin and a photocurable resin uniformly dissolved in a solvent and photocuring of the applied coating liquid.

The present invention further provides apparatus including the above image-bearing member.

Thus, the image-bearing member having a specific surface layer is almost free from abrasion during a durability test, shows a stable potential characteristic, provides images free from streaks due to scratches or density inclination due to local abrasion even after a long term of use, thus providing good copy images.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
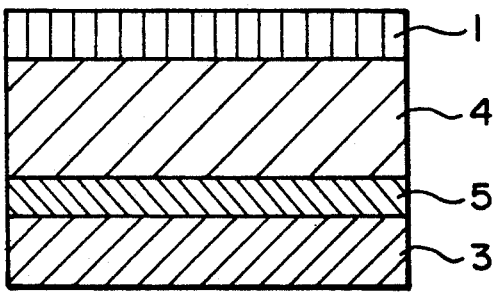
Figure 3:
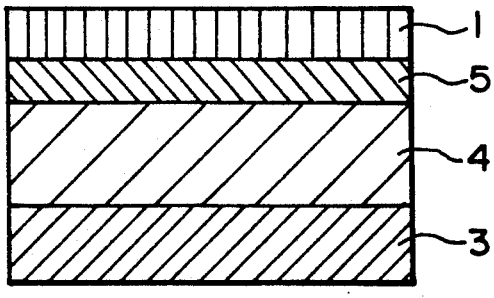

The image-bearing member according to the present invention will now be explained with respect to some embodiments thereof with reference to the drawings wherein like reference numerals denote like parts. More specifically, FIGS. 1–3 are schematic sectional views showing embodiments of the image-bearing member according to the present invention which respectively include a protective layer as the surface layer.

Figure 1:
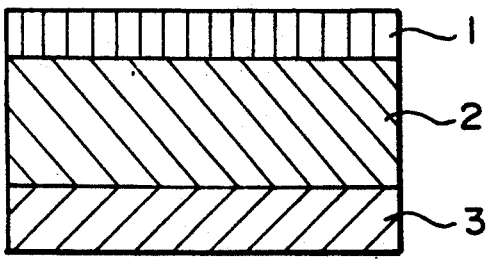
FIGS. 1 through 6 are respectively a schematic sectional view of an embodiment of the image-bearing member according to the present invention.

Referring to FIG. 1, the image-bearing member includes a protective layer 1 disposed as the outermost layer thereof to protect the inner layers, a photoconductive layer 2 which can be omitted from the image-bearing member of the present invention in some cases as described above, and a support 3. The photoconductive layer 2 can be formed as a laminate including a charge transport layer 4 and a charge generation layer 5 which may be disposed in an arbitrary order on the support 3 as shown in FIGS. 2 and 3.

The protective layer 1 shows a remarkably excellent abrasion resistance as well as a small friction coefficient, so that it is extremely useful as a surface protective layer of the image-bearing member. Such an effect which has not been attained heretofore may be attributable to synergistic functions of the high-melting point polyester resin and the cured resin in mixture unlike a conventionally used single species of resin or copolymer.

The protective layer 1 according to the present invention is very tough so that it can be made in a small thickness as lows as 3 microns or less, desirably 0.1–2 microns. The image-bearing member may have a photoconductive layer 2 as desired.

The photoconductive layer may comprise an inorganic photoconductive substance, such as Se, a-Si, ZnO and CdS, or an organic photoconductive substance, such as organic dyes, organic pigments and polysilane compounds. The photoconductive layer may have a variety of layer structures inclusive of a laminate comprising a charge generation layer 5 and a charge transport layer 4 disposed in that order on a support 3 (as shown in FIG. 2), a laminate comprising a charge transport layer 4 and a charge generation layer 5 disposed in that order on a support (as shown in FIG. 3), and also at least one layer 2 comprising a charge generation substance and a charge transport substance in mixture (as shown in FIG. 1). These layer structures are indicated by their essential structure and can further include an intermediate layer as desired. The respective layers used in the present invention inclusive of the photoconductive layer can further contain a third or optional component which may be a substance of a low-molecular weight or a macromolecular one.

Figure 4:
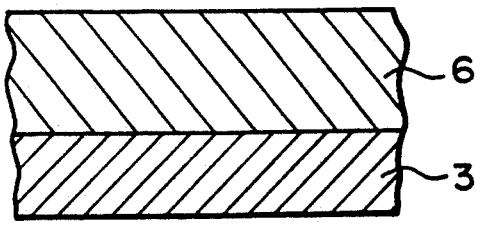
Figure 5:
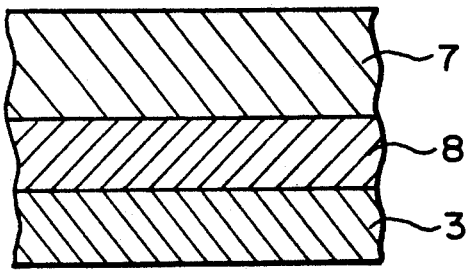
Figure 6:
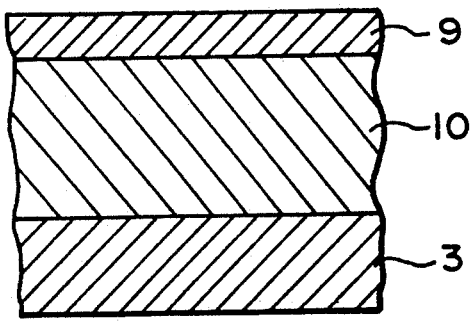

FIGS. 4–6 are schematic sectional views showing embodiments of the image-bearing member according to the present invention which respectively include a photoconductive layer as the surface layer. In these figures, the same kinds of layer are denoted by the same reference numerals.

Referring to FIG. 4, the image-bearing member includes a support 3 and a photoconductive layer 6 formed thereon comprising a high-melting point polyester resin, a cured resin, a charge generation substance and a charge transport substance. Such a photoconductive layer can be formed in a laminate structure including a charge transport layer 7 mainly comprising a charge transport substance, a high-melting point polyester resin and a cured resin, and a charge generation layer 8 mainly comprising a charge transport substance (as shown in FIG. 5), or a charge generation layer 9 mainly comprising a charge generation substance, a high-melting point polyester resin and a cured resin and a charge transport layer 10 mainly comprising a charge transport substance (as shown in FIG. 6).

Again, the photoconductive layer may comprise an inorganic photoconductive substance, such as Se, a-Si, ZnO and CdS, or an organic photoconductive substance, such as organic dyes, organic pigments and polysilane compounds. The photoconductive layer may have a variety of layer structures inclusive of a laminate as shown in FIGS. 4–6, and can further include an intermediate layer as desired.

The resin components used in the surface layer of the image-bearing member according to the invention inclusive of the above-mentioned protective layer 1, photoconductive layer 6, charge transport layer 7 and charge generation layer 9 will now be described.

The polyester refers to a polycondensation product between an acid component and an alcohol component, including a polymer obtained through condensation of a dicarboxylic acid and a glycol and a polymer obtained through condensation of a compound having both a hydroxy group and a carboxy group, such as hydroxybenzoic acid.

Examples of the acid component may include: aromatic dicarboxylic acids, such as terephthalic acid, isophthalic acid and naphthalenedicarboxylic acid; aliphatic dicarboxylic acids, such as succinic acid, adipic acid and sebacic acid; alicyclic dicarboxylic acids, such as hexahydroterephthalic acid; and oxycarboxylic acids, such as hydroxyethoxybenzoic acid.

Examples of the glycol component may include: ethylene glycol, trimethylene glycol, tetramethylene glycol, hexamethylene glycol, cyclohexanedimethylol, polyethylene glycol, and polypropylene glycol.

It is also possible to include a polyfunctional compound, such as pentaerythritol, trimethylolpropane, pyromellitic, or an ester-forming derivative thereof, for copolymerization as far as a substantially linear polyester resin is obtained.

The polyester resin used in the present invention is a high-melting point polyester resin.

The high-melting point polyester resin may have an intrinsic viscosity of 0.4 dl/g or higher, preferably 0.5 dl/g or higher, further preferably 0.65 dl/g or higher, as measured in orthochlorophenol at 36° C.

A preferred example of the high-melting point polyester resin may include a polyalkylene terephthalate-type resin which principally comprises terephthalic acid as the acid component and an alkylene glycol as the glycol component.

Specific examples of the polyalkylene terephthalate-type resin may include: polyethylene terephthalate (PET) which principally comprises a terephthalic acid component and an ethylene glycol component, polybutylene terephthalate (PBT) which principally comprises a terephthalic acid component and a 1,4-tetramethylene glycol (1,4-butylene glycol) component, and polycyclohexyldimethylene terephthalate (PCT) which principally comprises a terephthalic acid component and a cyclohexanedimethylol component.

Another preferred example of the high-melting point polyester resin may include a polyalkylene naphthalate-type resin which principally comprises naphthalenedicarboxylic acid as the acid component and an alkylene glycol as the glycol component. A specific example thereof may include polyethylene naphthalate (PEN) which principally comprises a naphthalenedicarboxylic acid component and an ethylene glycol component.

Herein, the term "principally comprise" used with respect to the high-melting point polyester resin means that a component in question occupies at least 50 mol % of the whole so as to retain the required high melting-point characteristic.

The high-melting point polyester resin may preferably have a melting point of 160° C. or higher, particularly 200° C. or higher.

The high-melting point polyester resin has a high crystallinity corresponding to a high melting point. As a result, the cured resin polymer chain and the polyester chain may entangle each other uniformly and densely to provide a highly durable surface layer. On the other hand, a low-melting point polyester resin has a low crystallinity so that it may provide a cite of high entanglement and a cite of low entanglement with the cured resin polymer chain.

It is possible to incorporate at least one species of other thermoplastic resins, such as polycarbonate, polyamide, polyallylate, polyoxymethylene, polyphenylene oxide, polyphenylene sulfide, polyethylene, polypropylene, ethylene-propylene-copolymer, polystyrene, styrene-butadiene copolymer, and also oligomer of saturated polyester resin, as far as it does not impair the wear-resistance characteristic of the high-melting point polyeste resin.

The cured resin component of the present invention may be formed from a curable resin component which is a resin capable of causing polymerization or crosslinkage on application of heat or preferably irradiation with actinic radiation such as ultraviolet rays preferably in the presence of a crosslinking agent or a photopolymerization initiator.

The curable resin component may preferably be an ionically curable (polymerizable or crosslinkable) resin. Such an ionically polymerizable or crosslinkable resin can cause polymerization or crosslinking without being inhibited by oxygen in the air so that the curing thereof may proceed evenly in the direction of thickness of the surface layer to provide a surface layer with a further excellent durability. Examples of such an ionically curable resin may include: epoxy resin, urethane resin, phenolic resin, melamine resin, acrylic resin and silicone resin. A specifically preferred class of the resin may be a cationically polymerizable resin.

It is preferred that the cationically polymerizable resin principally comprises (i.e., at a content of 50 wt. % or more) a single species or a mixture of two or more species of cationically polymerizable epoxy resins having two or more oxirane rings in a molecule. This type of epoxy resins may include: aromatic epoxy resins, novolak-type epoxy resins and alicyclic epoxy resins.

Commercially available examples of the aromatic epoxy resins may include: Epikote 828, Epikote 834, Epikote 1001, Epikote 1004, Epikote 1007, Epikote 190P and Epikote 191P (available from Yuka Shell Epoxy K.K.); DER 331, DER 332, DER 661, DER 664 and DER 667 (available from Dow Chemical Co.); and Araldite 260, Araldite 280, Araldite 6071, Araldite 6084 and Araldite 6097 (available from Ciba-Geigy Corp.). These may be used singly or in mixture.

Commercially available examples of the novolak-type epoxy resins may include: Epikote 153 and Epikote (available from Yuka Shell Epoxy K.K.); and Araldite EPN 1138, Araldite EPN 1139, Araldite ECN 1235, Araldite ECN 1273, Araldite ECN 1280 and Araldite ECN 1299 (available from Ciba-Geigy Corp.). These may be used singly or in mixture.

Commercially available examples of the alicyclic epoxy resins may include: Araldite CY 175, Araldite CY 177, Araldite CY 179 and Araldite CY 192 (available from Ciba-Geigy Corp.); and ERL 4221, ERL 4229 and ERL 4234 (available from Union Carbide Corp.). These may be used singly or in mixture.

In addition to the above, butadiene-type epoxy resins can also be used. Further, the above-mentioned various types of epoxy resins can also be used in mixture.

The cationically polymerizable resin can be used together with a monofunctional epoxy diluent within an extent of not lowering the curing characteristic. Examples of such a monofunctional epoxy diluent may include phenyl glycidyl ether, and t-butyl glycidyl ether.

Further, it is also possible to use a cationically polymerizable vinyl compound in mixture with the above-mentioned epoxy resin. Examples of such a cationically polymerizable compound may include: styrene, allylbenzene, triallyl isocyanate, triallyl cyanate, vinyl ether, N-vinylcarbazole, and N-vinylpyrrolidone.

The curing of the curable resin can be effected thermally but may preferably be effected as photocuring by irradiation with ultraviolet rays.

The photocuring may be performed in the presence of a photopolymerization initiator. A type of photopolymerization initiators liberating a Lewis acid, on ultraviolet irradiation, initiating the polymerization of a cationically polymerizable compound may include: aromatic diazonium salts, aromatic halonium salts and photosensitive aromatic onium salts of the VIb or Vb group elements.

The aromatic diazonium salts may be represented by the following general formula (I):

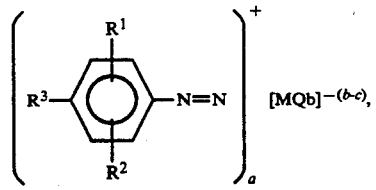

(I)

wherein $R^1$ and $R^2$ denote a hydrogen atom, an alkyl group or an alkoxy group; $R^3$ denotes a hydrogen atom, an aromatic group, an amide group or an aromatic group linked by a sulfur atom; M denotes a metal or a metalloid; Q denotes a halogen atom; a is a number of 1–6 satisfying the equation of $a=(b-c)$, b is a number satisfying the relation of $c<b\leqq 8$, and c is a number of 2–7 equal to the valence of M.

Specific examples thereof may include the following:

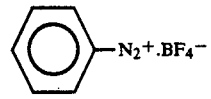

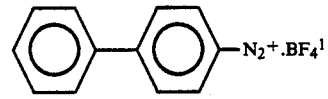

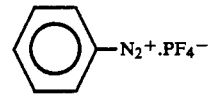

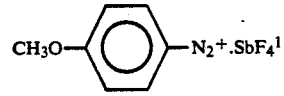

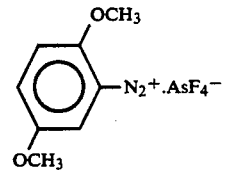

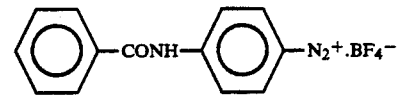

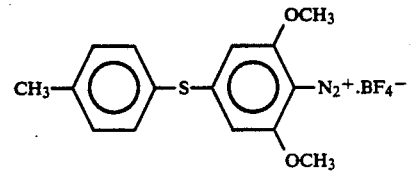

The above-mentioned aromatic onium salts may be represented by the following general formula (II):

$$[(R^4)_d(R^5)_eX]_f^+[MQ_g]^{-(g-h)} \quad \text{(II)},$$

wherein $R^4$ denotes a monovalent aromatic organic group, $R^5$ denotes a divalent aromatic organic group, X denotes a halogen atom, such as I, Br or Cl, M denotes a metal or metalloid, Q denotes a halogen atom, d is 0 or 2, e is 0 or 1, g is a number satisfying the relation of $h<g\leqq 8$, h is a number of 2–7 equal to the valence of M, and (d+e) is equal to 2 or the valence of X.

Specific examples thereof may include the following:

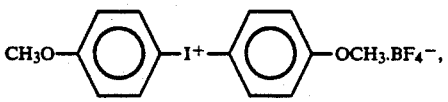

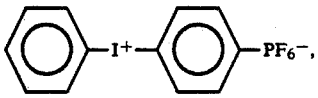

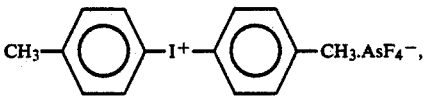

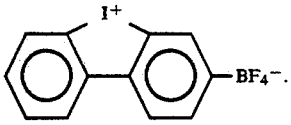

The above-mentioned photosensitive aromatic onium salts of the VIb or Vb elements may be represented by the following formula (III):

$$](R^6)_i(R^7)_d(R^8)_kY]_1^+[MQ_m]^{-(m-n)} \quad \text{(III)},$$

wherein $R^6$ denotes a monovalent aromatic organic group, $R^7$ denotes a monovalent aliphatic organic group selected from an alkyl group, a cycloalkyl group and a substituted alkyl group, $R^8$ denotes a polyvalent aliphatic or aromatic organic group having a heterocyclic ring structure Y denotes a VIb group element of S, Se or Te or a Vb group element of N, P, As, Sb or Bi; M denotes a metal or a metalloid; Q denotes a halogen atom; i is an integer of 0–4, j is an integer of 0–2, and k is an integer of 0–2 with proviso that (i+j+k) is equal to the valence of Y which is 3 when Y is a VIb group element or 4 when Y is a Vb group element, $i=(m-n)$, m is a number satisfying the relation of $n<m\leqq 8$, and n is a number of 2–7 equal to the valence of M.

The onium salts of the VIb group elements may include the following:

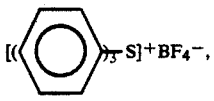

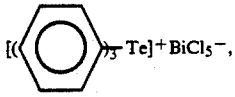

-continued

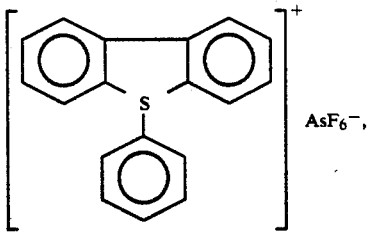

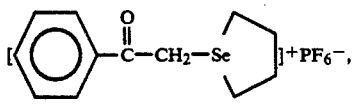

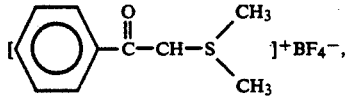

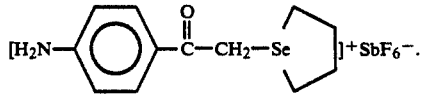

Further, the onium salts of the Vb group elements may include the following:

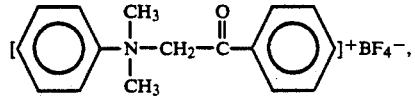

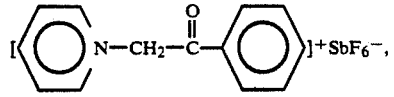

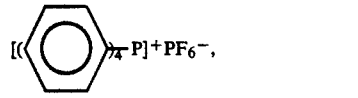

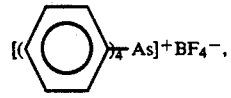

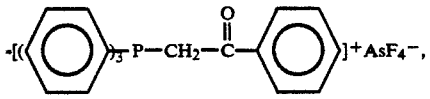

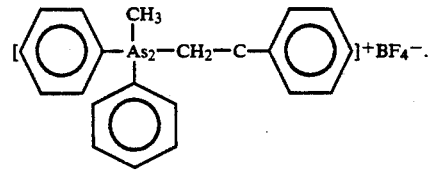

The resin composition including the high-melting point polyester resin and the curable resin may desirably be dissolved in a solvent and applied onto a substrate.

The solvent used for this purpose may comprise a solvent dissolving the high-melting point polyester resin which may generally be a single species of or a mixture solvent comprising two or more species of: cresols; halogenated hydrocarbons, such as chloroform dichloroethane, tetrachloroethane, trichloropropane, and tetrachlorobenzene; and fluorine-containing alcohols, such as tetrafluoroethanol, and hexafluoroisopropanol.

A particularly preferred example of the solvent may comprise a fluorine-containing alcohol such as tetrafluoroethanol or hexafluoroisopropanol, or a mixture solvent containing one or more species of the fluorine-containing alcohol. Such a fluorine-containing alcohol is more advantageous than a conventionally used chlorinated solvent because it hardly effects the electrophotographic characteristics and is durable against a long term of use even in an environment of high temperature and high humidity.

The curable resin (and thus the cured resin) may be incorporated in a proportion of 3–50 wt. parts, preferably 8–45 wt. parts, further preferably 10–40 wt. parts, per 100 wt. parts of the high-melting point polyester resin. The above-mentioned Lewis acid-liberating photopolymerization initiator may be used in a proportion of 0.1–50 wt. parts, preferably 1–30 wt. parts, per 100 wt. parts of the curable resin.

The application of the composition may be performed by an arbitrary method, such as dipping, roller coating, bar coating, spraying or brush coating. Particularly, the dipping is preferred because it provides a coating film with an excellent uniformity.

The irradiation with ultraviolet rays may be performed at a temperature of from room temperature to the decomposition temperature of the high-melting point polyester resin, preferably at a temperature of from the glass transition temperature to the melting-initiation temperature, particularly preferably at a temperature of from a temperature at least 20° C. above the glass transition temperature to a temperature at least 20° C. below the melting-initiation temperature, respectively of the high-melting point polyester resin. The irradiation may be performed for 60 seconds or less, preferably 30 seconds or less, further preferably 5–15 seconds.

The irradiation conditions may appropriately be selected depending on the amount of a solvent-insoluble content in the resultant cured product. The ultraviolet rays may have a wavelength of 200–500 nm, preferably 300–400 nm.

The surface layer according to the present invention comprising the specified resin components may be cured by irradiation with ultraviolet rays so as to provide an insoluble (gel) content of 10 wt. % or more, preferably 15 wt. % or more, particularly preferably 20 wt. % or more, as measured through a method wherein 100 mg of the resultant cured product is dissolved in 10 ml of a solvent for 1 hour under stirring and heating at 100° C. and the mixture is filtrated through a 3G-glass filter to leave an insoluble matter, which is then washed, dried by heating up to a constant temperature of 130° C. and weighed.

The support (e.g., those denoted by reference numeral 3 in FIGS. 1–6) constituting the image-bearing member according to the present invention may be in forms as described below:

(1) A plate or drum of a metal, such as aluminum, aluminum alloy, stainless steel or copper.

(2) A laminate of a non-conductive support of, e.g., glass, resin or paper, or a conductive support of (1) described above, coated with a film of a metal, such as aluminum, palladium, rhodium, gold or platinum by vapor deposition or bonding.

(3) A laminate of a non-conductive support of, e.g., glass, resin or paper, or a conductive support of (1) above coated with a layer of an electroconductive polymer, a vapor-deposited layer of a electroconductive compound such as tin oxide or indium oxide, or an applied layer of a dispersion paint comprising an electroconductive substance dispersed in an electroconductive or -nonconductive polymer.

It is also possible dispose a primer layer having a barrier function or an adhesive function between the support and the photoconductive layer. Such a primer layer may have a thickness of 5 microns or less, preferably 0.1–3 microns. The primer layer may for example be formed from casein, polyvinyl alcohol, nitrocellulose, polyamides (nylon 6, nylon 66, nylon 610, copolymer nylon, N-alkoxymethylated nylon, etc.), polyurethane, or aluminum oxide.

The charge generation substance used in the present invention may for example include the following substances, which may be used singly or in mixture of two or more species.

(1) Azo pigments, such as monoazo, bisazo and trisazo pigments;

(2) Phthalocyanine pigments, such as metal-phthalocyanines, and non-metallic phthalocyanines;

(3) Indigo pigments, such as indigo and thioindigo;

(4) Perylene pigments, such as perylenetetracarboxylic acid anhydride and perylenetetracarboxylic acid diimide;

(5) Polycyclic quinone pigments, inclusive, of condensed cyclic compounds such as anthraquinone and pyrenequinone;

(6) squarilium dyes;

(7) Pyrylium salts, thiopyrylium salts.

(8) Triphenylmethane dyes; and (9) Inorganic substances, such as selenium and amorphous silicon.

The charge generation layer, i.e., a layer containing a charge generation substance may be formed by applying a dispersion of the above-mentioned charge generation substance in an appropriate binder onto a support. Alternatively, the charge generation layer can also be formed by coating a support with a film of the charge generation substance by a dry process such as vapor deposition, sputtering or CVD.

The binder may be selected from a wide scope of resins having a binding function which may for example include: polycarbonate resin, polyester resin, polyallylate resin, butyral resin, polystyrene resin, polyvinyl acetal resin, diallyl phthalate resin, acrylic resin, methacrylic resin, vinyl acetate resin, phenolic resin, silicone resin, polysulfone resin, styrene-butadiene copolymer resin, alkyd resin, epoxy resin, urea resin, and vinyl chloride-vinyl acetate copolymer resin. However, these are not exhaustive.

These binders may be in the form of a homopolymer, a copolymer or a mixture of two or more species. The binder resin may constitute 80 wt. % or less, preferably 0–40 wt. % of the charge generation layer. The charge generation layer may preferably be in the form of a thin film having a thickness of 5 microns or less, particularly 0.01–1 micron.

The charge generation layer can further contain a sensitizer of various types.

The charge transport layer may be disposed above or below the charge generation layer and has a function of receiving charge carriers from the charge generation layer and transporting them. The charge transport layer may be formed by dissolving a charge transport substance together with a appropriate binder in a solvent and applying the resultant solution or dispersion. The thickness may be generally 5–40 microns, preferably 15–30 microns.

The charge transport substance includes an electron transport substance and a hole transport substance. Examples of the electron transport substance may include: electron-attractive substances, such 2,4,7-trinitrofluorenone, 2,4,5,7-tetranitrofluorenone, chloranil, and tetracyanoquinodimethane, and polymerized products of these electron-attractive substance.

Examples of the hole transport substance may include: polycyclic aromatic compounds, such as pyrene, and anthracene; heterocyclic compounds, such as carbazole, indole, imidazole, oxazole, thiazole, oxadiazole, pyrazole, pyrazoline, thiadiazole, and triazole; hydrazone compounds, such as p-diethylaminobenzaldehyde-N,N-diphenylhydrazone, and N,N-diphenylhydrazino-3-methylidene-9-ethylcarbazole; styryl compounds, such as α-phenyl-4'-N,N-diphenylaminostilbene, and 5-[4-(di-p-tolylamino)benzylidene]-5H-dibenzo[a,d]cycloheptene; benzidine compounds; triarylmethane compounds; triphenylamine; or polymers having these compounds in main chains or side chains, such as poly-N-vinylcarbazole and polyvinylanthracene.

In addition to the above-mentioned organic charge transport substance, it is also possible to use an inorganic substance, such as selenium selenium-tellurium, amorphous silicon (a-Si) or cadmium sulfide.

These charge transport substances may be used singly or in combination of two or more species.

A charge transport substance lacking a film forming characteristic may be used together with an appropriate binder resin. Specific examples of the binder may include: insulating resins or elastomers, such as acrylic resin, polyallylate, polyester, polycarbonate, polystyrene, acrylonitrile-styrene copolymer resin, polysulfone, polyacrylamide, polyamide, and chlorinated rubber; and organic photoconductive polymers, such as poly-N-vinylcarbazole, and polyvinyl anthracene.

According to another embodiment of the present invention, the image-bearing member may include a single layer containing both the above-mentioned azo pigment and a charge transport substance. The charge transport substance can be a charge transfer complex comprising poly-N-vinylcarbazole and trinitrofluorenone.

The image-bearing member according to this embodiment may be formed by applying a coating liquid comprising the above-mentioned azo pigment and charge transport substance dispersed in an appropriate resin solution onto a support, followed by drying.

The image-bearing member having a photoconductive layer according to the present invention is not only suitable as an electrophotographic photosensitive member for an electrophotographic copying apparatus but also widely applicable to fields of applied electrophotography, such as laser beam printers, CRT printers, LED printers, liquid crystal printers, laser plate production and facsimile printers.

The image-bearing member lacking a photoconductive layer according to the present invention may for example have a structure including a support and a surface layer disposed on the support by the medium of a dielectric layer, if desired, for the purpose of carrying an electrostatic image or a toner image. The surface layer may comprise a high-melting point polyester resin and a cured resin, particularly a photoionically cured resin.

The image-bearing member lacking a photoconductive layer may for example be applicable as an intermediate transfer member for a toner layer or an electrostatic latent image or as an electrostatic recording member.

Figure 7:
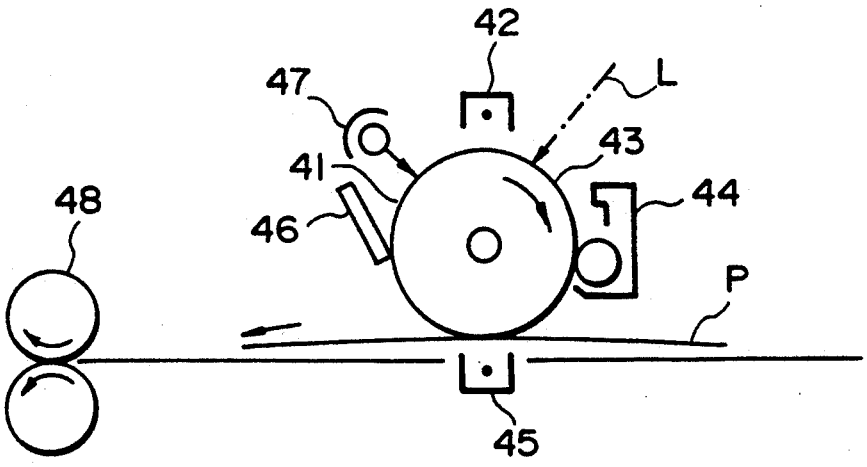
FIG. 7 is a schematic view illustrating the outline of a transfer-type electrophotographic apparatus equipped with an electrophotographic photosensitive member in the form of an ordinary drum.

FIG. 7 shows an outline of an ordinary transfer-type electrophotographic apparatus including an image-bearing member according to the present invention in the form of a photosensitive drum.

Referring to FIG. 7, the apparatus includes a drum-shaped photosensitive member 41 as an image-bearing member which rotates about an axis 41*a* at a prescribed peripheral speed in the direction of the arrow. In the course of the rotation, the peripheral surface of the photosensitive member 41 is uniformly charged to a positive or negative prescribed potential by a charging means 42 and then exposed to image light L by an imagewise exposure means (not shown, such as slit exposure means or laser beam scanning exposure means) at an exposure position 43. As a result, an electrostatic latent image corresponding to the exposure light image is sequentially formed on the peripheral surface of the photosensitive member.

The electrostatic latent image is then developed with a toner by a developing means 44, and the resultant toner image is sequentially transferred by a transfer means 45 onto a transfer material or paper P which has been supplied between the photosensitive member 41 and the transfer means 45 in synchronism with the rotation of the photosensitive member 41 by a paper-supplying unit (not shown).

The transfer material P having received the toner image is separated from the photosensitive member surface and introduced to an image fixing means 48 for image fixation to be discharged as a copy product out of the apparatus.

The surface of the photosensitive member 41 after the image transfer is subjected to removal of transfer-residual toner by a cleaning means 46 to be cleaned and used for repetitive image formation.

A corona charging device is widely used in general as the uniform charging means 42 for the photosensitive member 41. A corona transfer means is also widely used in general as the transfer means 45.

In the electrophotographic apparatus, plural members including some of the above-mentioned photosensitive member 41, developing means 44, cleaning means 46, etc., can be integrally combined to form an apparatus unit so that the unit can be readily connected to or released from the apparatus body. For example, the photosensitive member 41 and the cleaning means 46 can be integrated into a single unit so that it can be attached to or released from the apparatus body by a guide means such as a guide rail provided to the apparatus body. In this instance, the apparatus unit can also be integrally accompanied with the charging means 42 and/or the developing means 44.

In a case where the electrophotographic apparatus is used as a copying machine or a printer, the image light L is a reflected light or transmitted light from an original, or an image light formed by coding read data from an original and scanning a laser beam or driving a light-emitting diode array or a liquid crystal shutter array based on the coded data.

Figure 8:
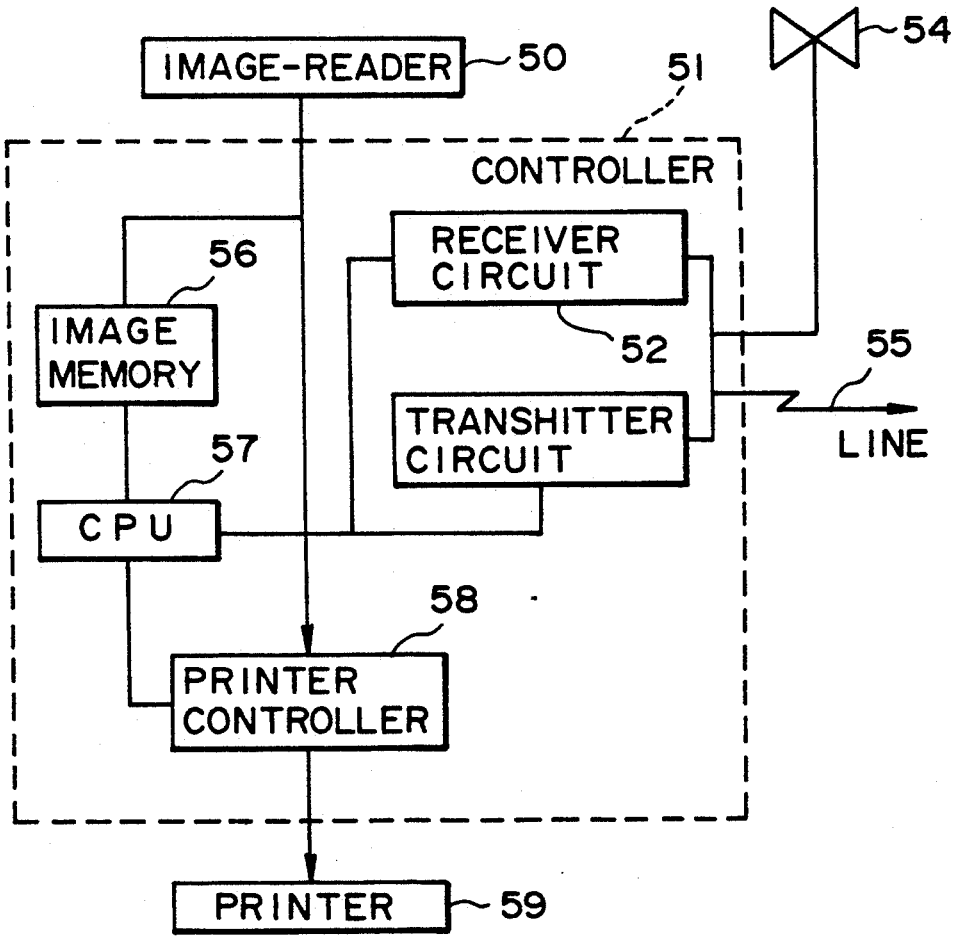
FIG. 8 is a block diagram of a facsimile system including such an electrophotographic apparatus as a printer.

In a case where the image forming apparatus is used as a printer for facsimile, the image light L may be replaced by exposure light image for printing received data. FIG. 8 is a block diagram for illustrating such an embodiment.

Referring to FIG. 8, a controller 51 controls an image reader (or image reading unit) 50 and a printer 59. The entirety of the controller 51 is regulated by a CPU 57. Data read from the image reader 50 is transmitted through a transmitter circuit 53 to a remote terminal such as another facsimile machine. On the other hand, data received from a remote terminal is transmitted through a receiver circuit 52 to a printer 59. An image memory 56 stores prescribed image data. A printer controller 58 controls the printer 59. A telephone hand-set 54 is connected to the receiver circuit 52 and the transmitter circuit 53.

More specifically, an image received from a line (or circuit) 55 (i.e., image data received from a remote terminal connected by the line) is demodulated by means of the receiver circuit 52, decoded by the CPU 57, and sequentially stored in the image memory 56. When image data corresponding to at least one page is stored in the image memory 56, image recording or output is effected with respect to the corresponding page. The CPU 57 reads image data corresponding to one page from the image memory 56, and transmits the decoded data corresponding to one page to the printer controller 58. When the printer controller 58 receives the image data corresponding to one page from the CPU 57, the printer controller 58 controls the printer 59 so that image data recording corresponding to the page is effected. During the recording by the printer 59, the CPU 57 receives another image data corresponding to the next page.

Thus, receiving and recording of an image may be effected in the above-described manner by using an electrophotographic apparatus equipped with an image-bearing member according to the present invention as a printer.

Hereinbelow, the present invention described more specifically based on Examples wherein "part(s)" is used to mean "part(s) by weight". Incidentally, the melting point data described with respect to polyesters were measured in the following manner.

A sample polyester resin is once melted at a sufficiently high temperature (e.g., at 280 ° C. for Example 1) and then rapidly cooled by iced-water. The melting point of the polyester resin is measured by using 0.5 g of the thus treated sample and a differential scanning calorimeter (DSC) at a temperature-raising rate of 10 ° C./min.

EXAMPLE 1-1

An aluminum cylinder having an outer diameter of 80 mm × a length of 360 mm was provided as a support and coated by dipping with a 5%-methanol solution of alkoxymethylated nylon, followed by drying, to form a 1 micron-thick primer layer (intermediate layer).

Then, 10 parts of a pigment of the formula below, 8 parts of polyvinyl butyral and 50 parts of cyclohexanone were dispersed for 20 hours in a sand mill using 100 parts of 1 mm-dia. glass beads. The resultant dispersion was diluted with an appropriate amount (70–120 parts) of methyl ethyl ketone and applied onto the primer layer, followed by 5 min. of drying at 100° C., to form a 0.2 micron-thick charge generation layer.

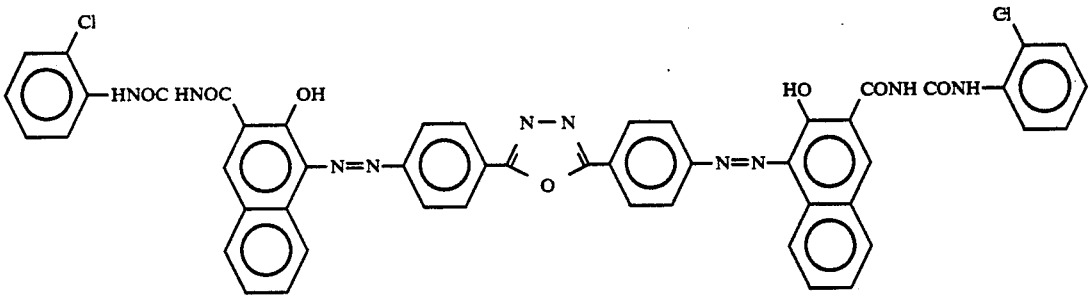

Separately, 10 parts of a styryl compound of the formula shown below and 10 parts of bisphenol Z-type polycarbonate were dissolved in 65 parts of monochlorobenzene. The resultant solution was applied by dipping onto the charge generation layer, followed by 60 min. of hot air drying at 120° C., to form a 20 micron-thick charge transport layer.

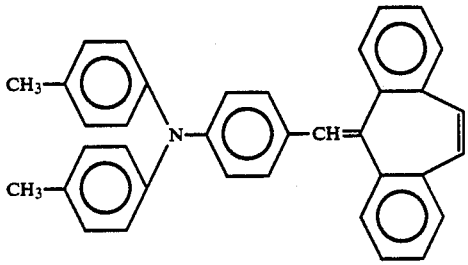

Then, the charge transport layer was coated with a 1.0 micron-thick protective layer in the following manner.

100 parts of a high-melting point polyester resin (A) (polyethylene terephthalate) ([η] (intrinsic viscosity)=0.70 dl/g, Tmp (melting point)=258° C., Tg (glass transition temperature)=70° C.) obtained from terephthalic acid as the acid component and ethylene glycol as the glycol component and 30 parts of an epoxy resin (B) (epoxy equivalent=160, aromatic ester-type, Epikote 190P (trade name) mfd. by Yuka Shell Epoxy K.K.) were dissolved in 100 ml of a phenol/tetrachloroethane (=1/1) mixture solvent. Then, 3 parts of triphenylsulfonium hexafluoroantimonate (C) as a photopolymerization initiator was added thereto to form a resin composition solution.

The solution was applied by dipping onto the charge transport layer, dried for 10 min. at 65° C. and then irradiated for curing.

The irradiation was performed for 8 seconds at 130° C. from a 2 KW-high pressure-mercury lamp (30 W/cm) disposed 20 cm apart from the coated cylinder.

The thus-prepared photosensitive member (drum) was incorporated in a commercially available copying machine (NP-3525 (trade name) mfd. by Canon K.K.) and subjected to a successive copying test of $60\times10^4$ sheets in an environment of a temperature of 24° C. and a relative humidity of 55%. The results are shown in Table 1-1 appearing hereinafter.

COMPARATIVE EXAMPLE 1-1

A photosensitive member was prepared in the same manner as in Example 1-1 except that the protective layer was not provided. The photosensitive member was subjected to the same successive copying test as in Example 1-1. The results are also shown in Table 1-1.

COMPARATIVE EXAMPLE 1-2

A photosensitive member was prepared in the same manner as in Example 1-1 except that the protective layer was replaced by one formed by mixing and dispersing 4 parts of bisphenol Z-type polycarbonate (the same as used in the charge transport layer (CTL)), 70 parts of monochlorobenzene and 1 part of PTFE (polytetrafluoroethylene) fine powder in a sand mill for 10 hours to prepare a coating liquid and spraying the coating liquid, followed by drying, to form a 1.0 micron-thick protective layer. The photosensitive member was subjected to the same successive copying test as in Example 1-1. The results are also shown in Table 1-1.

COMPARATIVE EXAMPLE 1-3

A photosensitive member was prepared in the same manner as in Comparative Example 1-2 except that the protective layer was formed in a thickness of 12.0 microns by spraying the same coating liquid represented, followed by drying. The photosensitive member was subjected to the same successive copying test as in Example 1-1. The results are also shown in Table 1-1.

EXAMPLE 1-2

A photosensitive member was prepared and tested in the same manner as in Example 1-1 except that the high-melting point polyester resin (A) was replaced by one ($[\eta]=0.68$ dl/g, Tmp=210° C., Tg=68° C.) prepared by using terephthalic acid as the acid component and a mixture of 80 mole % of ethylene glycol and 20 mole % of polyethylene glycol (Mw (molecular weight)=1,000) as the glycol component. The results are also shown in Table 1-1.

EXAMPLE 1-3

A photosensitive member was prepared and tested in the same manner as in Example 1-1 except that the high-melting point polyester resin (A) was replaced by one ($[\eta]=0.67$ dl/g, Tmp=195° C., Tg=65° C.) prepared by using terephthalic acid as the acid component and a mixture of 63 mole % of ethylene glycol and 37 mole % of polyethylene glycol as the glycol component. The results are also shown in Table 1-1.

EXAMPLE 1-4

A photosensitive member was prepared and tested in the same manner as in Example 1-1 except that the high-melting point polyester resin (A) was replaced by one ($[\eta]=0.66$ dl/g, Tmp=180° C., Tg=64° C.) prepared by using terephthalic acid as the acid component and a mixture of 50 mole % of ethylene glycol and 50 mole % of polyethylene glycol as the glycol component. The results are also shown in Table 1-1.

EXAMPLE 1-5

A photosensitive member was prepared and tested in the same manner as in Example 1-1 except that the high-melting point polyester resin (A) was replaced by one ($[\eta]=0.64$ dl/g, Tmp=161° C., Tg=60° C.) prepared by using terephthalic acid as the acid component and a mixture of 40 mole % of ethylene glycol and 60 mole % of polyethylene glycol as the glycol component. The results are also shown in Table 1-1.

EXAMPLE 1-6

A photosensitive member was prepared and tested in the same manner as in Example 1-1 except that the epoxy resin (B) as the curable resin was replaced by an epoxy resin (epoxy equiv.=184–194, bisphenol-type, Epikote 828 (trade name) mfd. by Yuka Shell Epoxy K.K.). The results are also shown in Table 1-1.

EXAMPLE 1-7

A photosensitive member was prepared and tested in the same manner as in Example 1-1 except that the amount of the epoxy resin (B) was reduced to 10 parts to prepare a protective layer, which was found to have a thickness of 0.8 micron. The result are shown in Table 1-1.

EXAMPLE 1-8

A photosensitive member was prepared and tested in the same manner as in Example 1-1 except that the irradiation with the high-pressure mercury lamp was performed for 5 seconds to form a protective layer, which was found to have a thickness of 0.9 micron. The results are shown in Table 1-1.

EXAMPLE 1-9

An aluminum cylinder coated with a primer layer was provided in the same manner as in Example 1-1.

Then, 3 parts of ε-type Cu-PC (phthalocyanine) as a charge generation substance, 6 parts of a hydrazone compound of the formula shown below as a charge transport substance, 6 parts of the bisphenol Z-type polycarbonate used in Example 1-1 and 50 parts of monochlorobenzene were mixed and dispersed for 30 hours in a sand mill to prepare a coating liquid.

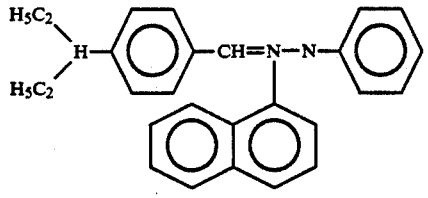

The coating liquid was applied by spraying onto the primer layer to form a 20 micron-thick photoconductive layer.

Then, a 1.0 micron-thick protective layer was formed on the photoconductive layer in the same manner as in Example 1-1 to prepare a photosensitive member, which was subjected to the same successive copying test as in Example 1-1. The results are shown in Table 1-1.

EXAMPLE 1-10

A photosensitive member was prepared in the same manner as in Example 1-1 except that the order of formation of the charge generation layer and the charge transport layer was reversed. The results are shown in Table 1-1. The protective layer formed was found to have a thickness of 0.9 micron.

EXAMPLE 1-11

An aluminum cylinder coated with a primer layer was provided in the same manner as in Example 1-1.

Then, 10 parts of an oxytitanium phthalocyanine pigment having a crystal form characterized by main peaks specified by Bragg angles (20±0.2 degree) of 9.0 degrees, 14.2 degrees, 23.9 degrees and 27.1 degrees in X-ray diffraction pattern based on CuKα characteristic X rays, 8 parts of polyvinyl butyral and 50 parts of cyclohexanone were dispersed for 20 hours in a sand mill using 100 parts of 1 mm-dia. glass beads. The resultant dispersion was diluted with an appropriate amount (70–120 parts) of methyl ethyl ketone and applied onto the primer layer, followed by 5 min. of drying at 100° C., to form a 0.2 micron-thick charge generation layer.

Separately, 10 parts of a styryl compound of the formula shown below and 10 parts of bisphenol Z-type polycarbonate were dissolved in 65 parts of monochlorobenzene. The resultant solution was applied by dipping onto the charge generation layer, followed by 60 min. of hot air drying at 120° C., to form a 20 micron-thick charge transport layer.

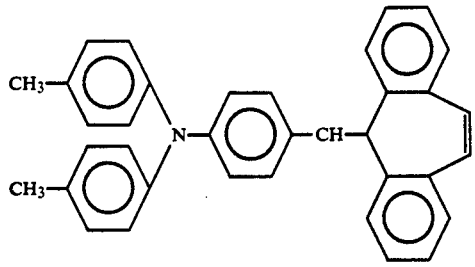

Then, the charge transport layer was coated with a 1.0 micron-thick protective layer in the following manner.

100 parts of a high-melting point polyester resin (polybutylene terephthalate) ([η]=0.72 dl/g, Tmp=224° C., Tg=35° C.) obtained from terephthalic acid as the acid component and 1,4-tetramethylene glycol as the glycol component and 30 parts of the epoxy resin (B) used in Example 1-1 were dissolved in 100 ml of a phenol/tetrachloroethane (=1/1) mixture solvent. Then, 3 parts of triphenylsulfonium hexafluoroantimonate as a photopolymerization initiator was added thereto to form a resin composition solution.

The solution was applied by dipping onto the charge transport layer, dried and then irradiated for curing.

The irradiation was performed for 8 seconds at 130° C. from a 2 KW-high pressure-mercury lamp (30 W/cm) disposed 20 cm apart from the coated cylinder.

The thus-prepared photosensitive member (drum) was incorporated in a commercially available copying machine (NP-3525 (trade name) mfd. by Canon K.K.) and subjected to a successive copying test of $60\times10^4$ sheets in the same manner as in Example 1-1. The results are shown in Table 1-2 appearing hereinafter.

COMPARATIVE EXAMPLE 1-4

A photosensitive member was prepared in the same manner as in Example 1-11 except that the protective layer was not provided. The photosensitive member was subjected to the same successive copying test as in Example 1-1. The results are also shown in Table 1-2.

COMPARATIVE EXAMPLE 1-5

A photosensitive member was prepared in the same manner as in Example 1-11 except that the protective layer was replaced by one formed by mixing and dispersing 4 parts of bisphenol Z-type polycarbonate (the same as used in the charge transport layer (CTL)), 70 parts of monochlorobenzene and 1 part of PTFE fine powder in a sand mill for 10 hours to prepare a coating liquid and spraying the coating liquid, followed by drying, to form a 1.0 micron-thick protective layer. The photosensitive member was subjected to the same successive copying test as in Example 1-11. The results are also shown in Table 1-2.

COMPARATIVE EXAMPLE 1-6

A photosensitive member was prepared in the same manner as in Comparative Example 1-5 except that the protective layer was formed in a thickness of 12.0 microns by spraying the same coating liquid represented, followed by drying. The photosensitive member was subjected to the same successive copying test as in Example 1-11. The results are also shown in Table 1-2.

COMPARATIVE EXAMPLE 1-7

A photosensitive member was prepared and tested in the same manner as in Example 1-1 except that the high-melting point polyester resin (A) was replaced by a polyester resin ("Vylon 200" (trade name), mfd. by Toyobo Co. Ltd.) having a softening point of 163° C. (having no melting point because of non-crystallinity). The results are shown in Table 1-1.

EXAMPLE 1-12

A photosensitive member was prepared and tested in the same manner as in Example 1-11 except that the high-melting point polyester resin was replaced by high-melting point polycyclohexanedimethylene terephthalate resin ([η]=0.66 dl/g, Tmp=290° C., Tg=80° C.) prepared by using terephthalic acid as the acid component and cyclohexanedimethylol as the glycol component. The results are also shown in Table 1-2.

EXAMPLE 1-13

A photosensitive member was prepared and tested in the same manner as in Example 1-11 except that the high-melting point polyester resin was replaced by high-melting point polyethylene naphthalate resin ([η]=0.69 dl/g, Tmp=280° C., Tg=85° C.) prepared by using 1,10-naphthalenedicarboxylic acid as the acid component and a mixture of 80 mole % of ethylene glycol and ethylene glycol as the glycol component. The results are also shown in Table 1-2.

EXAMPLE 1-14

A photosensitive member was prepared and tested in the same manner as in Example 1-11 except that the high-melting point polyester resin was replaced by one ([η]=0.67 dl/g, Tmp=190° C., Tg=15° C.) prepared by using terephthalic acid as the acid component and a mixture of 63 mole % of 1,4-tetramethylene glycol and 37 mole % of polyethylene glycol as the glycol component. The results are also shown in Table 1-2.

EXAMPLE 1-15

A photosensitive member was prepared and tested in the same manner as in Example 1-11 except that the epoxy resin as the curable resin was replaced by the epoxy resin used in Example 1-6. The results are also shown in Table 1-2.

EXAMPLE 1-16

A photosensitive member was prepared and test in the same manner as in Example 1-11 except that the amount of the epoxy resin was reduced to 10 parts to prepare a protective layer, which was found to have a thickness of 0.9 micron. The result are shown in Table 1-2.

EXAMPLE 1-17

A photosensitive member was prepared and tested in the same manner as in Example 1-11 except that the irradiation with the high-pressure mercury lamp was performed for 5 seconds to form a protective layer, which was found to have a thickness of 1.0 micron. The results are shown in Table 1-2.

EXAMPLE 1-18

An aluminum cylinder coated with a primer layer was provided in the same manner as in Example 1-11.

Then, 3 parts of the pigment used in Example 1-11 as a charge generation substance, 6 parts of the styryl compound used in Example 1-1 as a charge transport substance, 6 parts of the bisphenol Z-type polycarbonate used in Example 1-11 and 50 parts of monochlorobenzene were mixed and dispersed for 30 hours in a sand mill to prepare a coating liquid.

The coating liquid was applied by spraying onto the primer layer to form a 20 micron-thick photoconductive layer.

Then, a 1.0 micron-thick protective layer was formed on the photoconductive layer in the same manner as in Example 1-11 to prepare a photosensitive member, which was subjected to the same successive copying test as in Example 1-11. The results are shown in Table 1-2.

EXAMPLE 1-19

A photosensitive member was prepared in the same manner as in Example 1-11 except that the order of formation of the charge generation layer and the charge transport layer was reversed. The results are shown in Table 1-1. The protective layer formed was found to have a thickness of 0.8 micron.

EXAMPLE 1-20

A photosensitive member was prepared and tested in the same manner as in Example 1-11 except that 100 ml of hexafluoroisopropanol was used in place of 100 ml of the phenol/tetrachloroethane (1/1) mixture solvent for formation of the protective layer. The results are shown in Table 1-2.

EXAMPLE 1-21 and 1-22

The photosensitive members of Examples 1-11 and 1-20 were respectively subjected to a successive copying test of $10\times10^4$ sheets by using a copying machine (NP-3525 (trade name) mfd. by Canon K.K.) in an environment of a temperature of 30° C. and a relative humidity of 85%. The results are shown in Table 1-2.

TABLE 1-1

| | Initial stage | | | | After successive copying test | | | | | | |
|---|---|---|---|---|---|---|---|---|---|---|---|
| | Vd (−V) | Vl (−V) | Vr*1 (−V) | Image evaluation | Vd (−V) | Vl (−V) | Vr*1 (−V) | Image evaluation | Scraped thickness (μm) | Number of copied sheets | Overall evaluation*** |
| Ex. | | | | | | | | | | | |
| 1-1 | 700 | 140 | 10 | Good | 690 | 150 | 20 | Good | 0.1 | 60 | AA |
| 1-2 | 705 | 135 | 10 | Good | 700 | 140 | 15 | Good | 0.1 | 60 | AA |
| 1-3 | 710 | 145 | 15 | Good | 710 | 155 | 20 | Good | 0.3 | 60 | AA |
| 1-4 | 710 | 140 | 15 | Good | 700 | 150 | 20 | Good | 0.3 | 60 | AA |
| 1-5 | 700 | 135 | 10 | Good | 690 | 160 | 15 | Good | 0.6 | 60 | AA |
| 1-6 | 705 | 140 | 10 | Good | 700 | 165 | 20 | Good | 0.2 | 60 | AA |
| 1-7 | 700 | 140 | 15 | Good | 700 | 160 | 25 | Good | 0.2 | 60 | AA |
| 1-8 | 700 | 145 | 20 | Good | 725 | 160 | 30 | Good | 0.2 | 60 | AA |
| 1-9 | −700 | −160 | −20*2 | Good | −710 | −180 | −30*2 | Good | 0.1 | 60 | AA |
| 1-10 | −710 | −150 | −70*2 | Good | −660 | −165 | −100*2 | Good | 0.1 | 60 | AA |
| Comp. Ex. | | | | | | | | | | | |
| 1-1 | 700 | 145 | 15 | Good | (460 | 200 | 95) | Poor | 12.6 | 6 | CC |
| 1-2 | 700 | 195 | 45 | Good | (470 | 205 | 85) | Poor | 11.2 | 11 | BB |
| 1-3 | 710 | 135 | 10 | Good | (700 | 530 | 490) | Poor | 0.6 | 0.2 | DD |
| 1-7 | 700 | 145 | 20 | Good | (450 | 190 | 80) | Poor | 10.9 | 8 | BC |

Note:

*1Vd: dark potential, Vl: light potential (illuminance: 3 lux.sec), Vr: remanent potential.

*2The polarity of the initial charge was changed to − (negative) in Examples 1-9 and 1-10.

Overall evaluation***

AA: No problem.

BB: White dropout occurred in the near side (lower side) of the images at the time of copying around $11\times10^4$ sheets. The successive copying test was interrupted.

BC: White dropout occurred in the near side (lower side) of the images at the time of copying around $8\times10^4$ sheets. The successive copying test was interrupted.

CC: White dropout occurred in the near side (lower side) of the images at the time of copying around $6\times10^4$ sheets. The successive copying test was interrupted.

DD: Black streaks occurred at the time of copying about 1000 sheets. Fog became intensive at the time of copying of 2000 sheets, when the successive copying test was interrupted.

TABLE 1-2

| | Initial stage | | | | After successive copying test | | | | | | |
|---|---|---|---|---|---|---|---|---|---|---|---|
| | Vd (−V) | Vl (−V) | Vr*1 (−V) | Image evaluation | Vd (−V) | Vl (−V) | Vr*1 (−V) | Image evaluation | Scraped thickness (μm) | Number of copied sheets | Overall evaluation*** |
| Ex. | | | | | | | | | | | |
| 1-11 | 700 | 135 | 5 | Good | 695 | 140 | 20 | Good | 0.1 | 60 | AA |
| 1-12 | 705 | 145 | 15 | Good | 705 | 145 | 20 | Good | 0.1 | 60 | AA |
| 1-13 | 710 | 145 | 15 | Good | 700 | 145 | 20 | Good | 0.1 | 60 | AA |
| 1-14 | 710 | 145 | 20 | Good | 700 | 155 | 25 | Good | 0.3 | 60 | AA |
| 1-15 | 705 | 140 | 15 | Good | 705 | 160 | 25 | Good | 0.2 | 60 | AA |
| 1-16 | 700 | 145 | 20 | Good | 700 | 165 | 30 | Good | 0.2 | 60 | AA |
| 1-17 | 700 | 140 | 20 | Good | 720 | 150 | 30 | Good | 0.2 | 60 | AA |
| 1-18 | −700 | −150 | −20*2 | Good | −710 | −160 | −25*2 | Good | 0.1 | 60 | AA |
| 1-19 | −700 | −155 | −60*2 | Good | −650 | −170 | −90*2 | Good | 0.1 | 60 | AA |
| 1-20 | 700 | 125 | 0 | Good | 690 | 130 | 5 | Good | 0.1 | 60 | AA |
| 1-21*3 | 695 | 120 | 10 | Good | 700 | 175 | 65 | Good | <0.1 | 10 | AA |
| 1-22*3 | 700 | 120 | 0 | Good | 700 | 125 | 5 | Good | <0.1 | 10 | AA |
| Comp. Ex. | | | | | | | | | | | |
| 1-4 | 700 | 145 | 15 | Good | (460 | 200 | 95) | Poor | 12.6 | 6 | CC |
| 1-5 | 700 | 195 | 45 | Good | (470 | 205 | 85) | Poor | 11.2 | 11 | BB |
| 1-6 | 710 | 135 | 10 | Good | (770 | 530 | 490) | Poor | 0.6 | 0.2 | DD |

Note
*1The same as in Table 1-1.
*2The polarity of the initial charge was changed to − (negative) in Examples 1-18 and 1-19.
*3The test for Examples 1-21 and 1-22 was performed in the environment of a temperature of 30° C. and a relative humidity of 85%.
Overall evaluation***
AA, BB, CC, DD: All the same as in Table 1-1.

EXAMPLE 2-1

An aluminum cylinder having an outer diameter of 80 mm×a length of 360 mm was provided as a support and coated by dipping with a 5%-methanol solution of alkoxymethylated nylon, followed by drying, to form a 1 micron-thick primer layer (intermediate layer).

Then, 10 parts of a pigment of the formula below, 8 parts of polyvinyl butyral and 50 parts of cyclohexane were dispersed for 20 hours in a sand mill using 100 parts of 1 mm-dia. glass beads. The resultant dispersion was diluted with an appropriate amount (70–120 parts) of methyl ethyl ketone and applied onto the primer layer, followed by 5 min. of drying at 100° C., to form a 0.2 micron-thick charge generation layer (CGL).

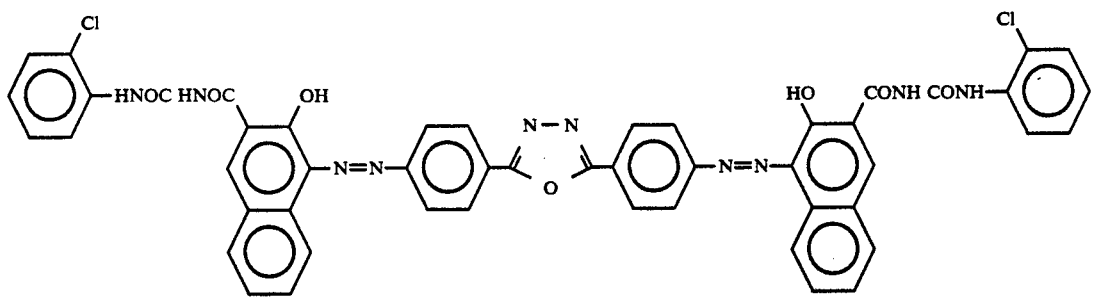

Separately, 100 parts of a high-melting point polyester resin (polyethylene terephthalate) ([η]=0.70 dl/g, Tmp=258° C., Tg=70° C.) obtained from terephthalic acid as the acid component and ethylene glycol as the glycol component and 30 parts of an epoxy resin (epoxy equivalent=160, aromatic ester-type, Epikote 190P (trade name) mfd. by Yuka Shell Epoxy K.K.) were dissolved in 100 ml of a phenol/tetrachloroethane (=1/1) mixture solvent. Then, 3 parts of triphenylsulfonium hexafluoroantimonate as a photopolymerization initiator was added thereto to form a resin composition solution.

Into the resin composition solution, 130 parts of a hydrazone compound of the formula shown below was dissolved to form a coating liquid (containing the hydrazone compound and the resin components in a weight ratio of 1:1).

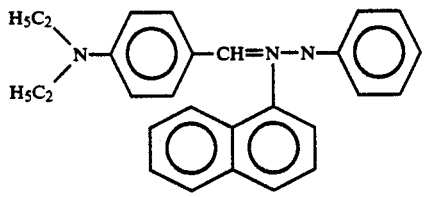

The thus prepared coating liquid was applied by dipping onto the above-prepared charge generation layer, followed by drying for 60 min. at 65° C. and photo-irradiation for curing to form a 20 micron-thick charge transport layer (CTL).

The irradiation was performed for 8 seconds at 130° C. from a 2 KW-high pressure-mercury lamp (30 W/cm) disposed 20 cm apart from the coated cylinder.

The thus-prepared photosensitive member (drum) was incorporated in a commercially available copying machine (NP-3525 (trade name) mfd. by Canon K.K.) and subjected to a successive copying test of 60×10⁴ sheets in an environment of a temperature of 24° C. and a relative humidity of 55%. The results are shown in Table 2-1 appearing hereinafter.

EXAMPLE 2-2

A photosensitive member was prepared and tested in the same manner as in Example 2-1 except that the high-melting point polyester resin was replaced by one ([η]=0.68 dl/g, Tmp=210° C., Tg=68° C.) prepared by using terephthalic acid as the acid component and a mixture of 80 mole % of ethylene glycol and 20 mole % of polyethylene glycol (Mw=1,000) as the glycol component. The results are also shown in Table 2-1.

EXAMPLE 2-3

A photosensitive member was prepared and tested in the same manner as in Example 2-1 except that the high-melting point polyester resin was replaced by one ([η]=0.67 dl/g, Tmp=195° C., Tg=65° C.) prepared by using terephthalic acid as the acid component and a mixture of 63 mole % of ethylene glycol and 37 mole % of polyethylene glycol (Mw=1,000) as the glycol component. The results are also shown in Table 2-1.

EXAMPLE 2-4

A photosensitive member was prepared and tested in the same manner as in Example 2-1 except that the high-melting point polyester resin was replaced by one ([η]=0.66 dl/g, Tmp=180° C., Tg=64° C.) prepared by using terephthalic acid as the acid component and a mixture of 50 mole % of ethylene glycol and 50 mole % of polyethylene glycol (Mw=1,000) as the glycol component. The results are also shown in Table 2-1.

EXAMPLE 2-5

A photosensitive member was prepared and tested in the same manner as in Example 2-1 except that the high-melting point polyester resin was replaced by one ([η]=0.64 dl/g, Tmp=161° C., Tg=60° C.) prepared by using terephthalic acid as the acid component and a mixture of 40 mole % of ethylene glycol and 60 mole % of polyethylene glycol (Mw=1,000) as the glycol component. The results are also shown in Table 2-1.

EXAMPLE 2-6

A photosensitive member was prepared and tested in the same manner as in Example 1-1 except that the epoxy resin as the curable resin was replaced by an epoxy resin (epoxy equiv.=184–194, bisphenol-type, Epikote 828 (trade name) mfd. by Yuka Shell Epoxy K.K.). The results are also shown in Table 2-1.

COMPARATIVE EXAMPLE 2-1

A photosensitive member was prepared and tested in the same manner as in Example 2-1 except that the resin composition solution for preparation of the charge transport layer was replaced by one comprising 130 parts of bisphenol-type polycarbonate and 900 parts of monochlorobenzene. The results are show in Table 2-1.

COMPARATIVE EXAMPLE 2-2

In order to improve the durability of a type of the photosensitive member prepared in Comparative Example 2-1, a conventional protective layer using PTFE fine powder was provided in the following manner.

Thus, 4 parts of the above-mentioned bisphenol Z-type polycarbonate, 70 parts of monochlorobenzene and 1 part of PTFE fine powder were dispersed for 10 hours in a sand mill to prepare a coating liquid. The coating liquid was applied by spraying onto the charge transfer layer and dried to provide a 1.0 micron-thick protective layer.

The thus prepared photosensitive member was subjected to the same successive copying test as in Example 2-1. The results are shown in Table 2-1.

COMPARATIVE EXAMPLE 2-3

A photosensitive member was prepared in the same manner as in Comparative Example 2-2 except that the protective layer was formed in a thickness of 12.0 microns by spraying the same coating liquid represented, followed by drying. The photosensitive member was subjected to the same successive copying test as in Example 2-1. The results are also shown in Table 2-1.

COMPARATIVE EXAMPLE 2-4

A photosensitive member was prepared and tested in the same manner as in Example 2-1 except that the high-melting point polyester resin was replaced by a polyester resin ("Vylon 200" (trade name), mfd. by Toyobo Co. Ltd.) having a softening point of 163° C. (having no melting point because of non-crystallinity). The results are shown in Table 2-1.

EXAMPLE 2-7

An aluminum cylinder coated with a primer layer was provided in the same manner as in Example 2-1.

Then, 10 parts of a styryl compound of the formula shown below and 10 parts of polymethyl methacrylate were dissolved in 65 parts of THF (tetrahydrofuran). The resultant solution was applied by dipping onto the primer layer, followed by 70 min. of hot air drying at 125° C., to form a 15 micron-thick charge transport layer.

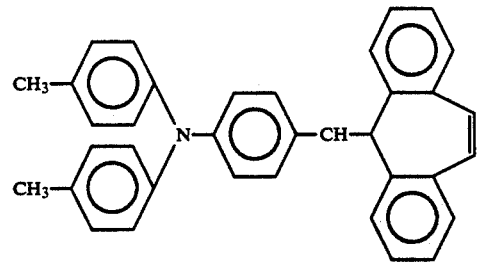

Separately, 10 parts of a pigment of the formula shown below and the resin composition solution used in Example 2-1 for providing the charge transport layer in an amount containing 7 parts of the resin component were mixed and dispersed for 20 hours in a sand mill to form a coating liquid. The coating liquid was applied onto the charge transport layer to form a 0.8 micron-thick charge generation layer.

The thus prepared photosensitive member was objected to the same successive copying test as in Example 2-1. The results are shown in Table 2-1.

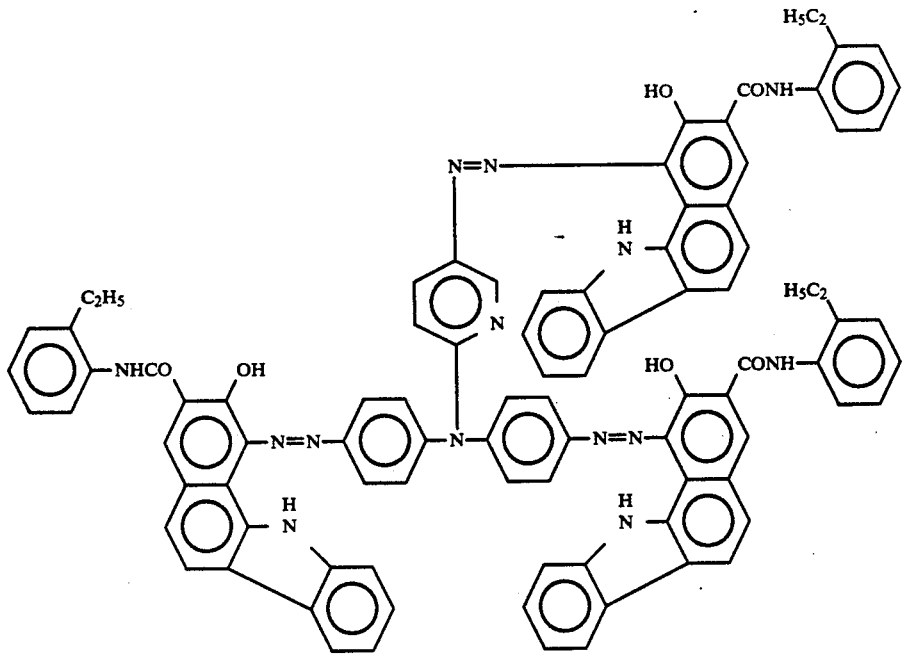

EXAMPLE 2-8

An aluminum cylinder coated with a primer layer was provided in the same manner as in Example 2-1.

Then, 3 parts of ϵ-type Cu-PC (phthalocyanine) as a charge generation substance, 6 parts of the hydrazone compound used in Example 2-1 and the resin composition solution used in Example 2-1 for providing the charge transport layer in an amount containing 10 parts of the resin component were mixed and dispersed for 30 hours in a sand mill to form a coating liquid. The coating liquid was applied onto the primer layer to form a 18 micron-thick photosensitive layer.

The thus prepared photosensitive member was subjected to the same successive copying test as in Example 2-1. The results are shown in Table 2-1.

EXAMPLE 2-9

A photosensitive member was prepared and tested in the same manner as in Example 2-1 except that the amount of the epoxy resin was reduced to 10 parts. The result are shown in Table 2-1.

EXAMPLE 2-10

A photosensitive member was prepared and tested in the same manner as in Example 2-1 except that the irradiation with the high-pressure mercury lamp was performed for 6 seconds. The results are shown in Table 2-1.

EXAMPLE 2-11

An aluminum cylinder coated with a primer layer was provided in the same manner as in Example 2-1.

Then, 10 parts of the pigment used in Example 2-1, 8 parts of polyvinyl butyral and 50 parts of cyclohexane were dispersed for 20 hours in a sand mill using 100 parts of 1 mm-dia. glass beads. The resultant dispersion was diluted with an appropriate amount (70–120 parts) of methyl ethyl ketone and applied onto the primer layer, followed by 5 min. of drying at 100° C., to form a 0.2 micron-thick charge generation layer (CGL).

Separately, 100 parts of a high-melting point polyester resin (polybutylene terephthalate) ([η]=0.72 dl/g, Tmp=224° C., Tg=35° C.) obtained from terephthalic acid as the acid component and 1,4-tetramethylene glycol (1,4-butane diol) as the glycol component and 30 parts of the epoxy resin used in Example 2-1 were dissolved in 100 ml of a phenol/tetrachloroethane (=1/1) mixture solvent. Then, 3 parts of triphenylsulfonium hexafluoroantimonate as a photopolymerization initiator was added thereto to form a resin composition solution.

Into the resin composition solution, 130 parts of the hydrazone compound used in Example 2-1 was dissolved to form a coating liquid, which was then applied by dipping onto the above-formed charge generation layer, followed by drying and photo-irradiation for curing, to form a 20 micron-thick charge transport layer (CTL).

The irradiation was performed for 8 seconds at 130° C. from a 2 KW-high pressure-mercury lamp (30 W/cm) disposed 20 cm apart from the coated cylinder.

The thus-prepared photosensitive member (drum) was incorporated in a commercially available copying machine (NP-3525 (trade name) mfd. by Canon K.K.) and subjected to a successive copying test of $60\times10^4$ sheets in an environment of a temperature of 24° C. and a relative humidity of 55%. The results are shown in Table 2-2 appearing hereinafter.

EXAMPLE 2-12

A photosensitive member was prepared and tested in the same manner as in Example 2-11 except that the high-melting point polyester resin was replaced by high-melting point polycyclohexanedimethylene terephthalate resin ([η]=0.66 dl/g, Tmp=290° C., Tg=80° C.) prepared by using terephthalic acid as the acid component and cyclohexanedimethylol as the glycol component. The results are also shown in Table 2-2.

EXAMPLE 2-13

A photosensitive member was prepared and tested in the same manner as in Example 2-11 except that the high-melting point polyester resin was replaced by high-melting point polyethylene naphthalate resin ([η]=0.69 dl/g, Tmp=280° C., Tg=85° C.) prepared by using 1,10-naphthalenedicarboxylic acid as the acid component and a mixture of 80 mole % of ethylene glycol and ethylene glycol as the glycol component. The results are also shown in Table 2-2.

EXAMPLE 2-14

A photosensitive member was prepared and tested in the same manner as in Example 2-11 except that the high-melting point polyester resin was replaced by one ([η]=0.67 dl/g, Tmp=190° C., Tg=15° C.) prepared by using terephthalic acid as the acid component and a mixture of 63 mole % of 1,4-tetramethylene glycol and 37 mole % of polyethylene glycol as the glycol component. The results are also shown in Table 2-2.

EXAMPLE 2-15

A photosensitive member was prepared and tested in the same manner as in Example 2-11 except that the epoxy resin as the curable resin was replaced by the epoxy resin used in Example 2-6. The results are also shown in Table 2-2.

EXAMPLE 2-16

An aluminum cylinder coated with a primer layer was provided in the same manner as in Example 2-1.

Then, 10 parts of the styryl compound used in Example 2-7 and 10 parts of polymethyl methacrylate used in Example 2-7 were dissolved in 65 parts of THF. The resultant solution was applied by dipping onto the primer layer followed by 70 min. of hot air drying at 125° C., to form a 15 micron-thick charge transport layer.

Separately, 10 parts of the pigment used in Example 2-7 and the resin composition solution used in Example 2-11 for providing the charge transport layer in an amount containing 7 parts of the resin component were mixed and dispersed for 20 hours in a sand mill to form a coating liquid. The coating liquid was applied onto the charge transport layer to form a 0.8 micron-thick charge generation layer.

The thus prepared photosensitive member was subjected to the same successive copying test as in Example 2-1. The results are shown in Table 2-2.

EXAMPLE 2-17

An aluminum cylinder coated with a primer layer was provided in the same manner as in Example 2-11.

Then, 3 parts of ε-type Cu-PC (phthalocyanine) as a charge generation substance, 6 parts of the hydrazone compound used in Example 2-1 and the resin composition solution used in Example 2-11 for providing the charge transport layer in an amount containing 10 parts of the resin component were dispersed for 30 hours in a sand mill to prepare a coating liquid. The coating liquid was applied onto the primer layer to form a 18 micron-thick photoconductive layer.

The thus obtained photosensitive member was subjected to the same successive copying test as in Example 2-11. The results are shown in Table 2-2.

EXAMPLE 2-18

A photosensitive member was prepared and test in the same manner as in Example 2-11 except that the amount of the epoxy resin was reduced to 10 parts. The result are shown in Table 2-2.

EXAMPLE 2-19

A photosensitive member was prepared and tested in the same manner as in Example 2-11 except that the irradiation with the high-pressure mercury lamp was performed for 6 seconds. The results are shown in Table 2-2.

EXAMPLE 2-20

A photosensitive member was prepared and tested in the same manner as in Example 2-11 except that 100 ml of hexafluoroisopropanol was used in place of 100 ml of the phenol/tetrachloroethane (1/1) mixture solvent. The results are shown in Table 2-2.

EXAMPLES 2-21 and 2-22

The photosensitive members of Examples 2-11 and 2-20 were respectively subjected to a successive copying test of $10\times10^4$ sheets by using a copying machine (NP-3525 (trade name) mfd. by Canon K.K.) in an environment of a temperature of 30° C. and a relative humidity of 85%. The results are shown in Table 2-2.

TABLE 2-1

| | Initial stage | | | | After successive copying test | | | | | | |
|---|---|---|---|---|---|---|---|---|---|---|---|
| | Vd (−V) | Vl (−V) | Vr*1 (−V) | Image evaluation | Vd (−V) | Vl (−V) | Vr*1 (−V) | Image evaluation | Scraped thickness (μm) | Number of copied sheets | Overall evaluation*** |
| Ex. | | | | | | | | | | | |
| 2-1 | 700 | 120 | 10 | Good | 700 | 130 | 15 | Good | 0.3 | 60 | AA |
| 2-2 | 700 | 110 | 10 | Good | 690 | 120 | 15 | Good | 0.3 | 60 | AA |
| 2-3 | 710 | 110 | 10 | Good | 685 | 125 | 15 | Good | 0.7 | 60 | AA |
| 2-4 | 710 | 115 | 10 | Good | 680 | 130 | 20 | Good | 0.7 | 60 | AA |
| 2-5 | 705 | 110 | 10 | Good | 670 | 135 | 15 | Good | 0.9 | 60 | AA |
| 2-6 | 710 | 125 | 10 | Good | 700 | 130 | 20 | Good | 0.4 | 60 | AA |
| 2-7 | −700 | 135 | −20*2 | Good | −670 | −145 | −25*2 | Good | 0.3 | 60 | AA |
| 2-8 | −710 | −140 | −25*2 | Good | −720 | −150 | −30*2 | Good | 0.4 | 60 | AA |
| 2-9 | 700 | 130 | 20 | Good | 710 | 145 | 25 | Good | 0.6 | 60 | AA |
| 2-10 | 705 | 125 | 10 | Good | 700 | 135 | 15 | Good | 0.6 | 60 | AA |
| Comp. Ex. | | | | | | | | | | | |
| 2-1 | 700 | 145 | 15 | Good | (460 | 200 | 95) | Poor | 12.6 | 6 | CC |
| 2-2 | 700 | 195 | 45 | Good | (470 | 205 | 85) | Poor | 11.2 | 11 | BB |
| 2-3 | 710 | 140 | 25 | Good | (730 | 480 | 420) | Poor | 0.6 | 0.2 | DD |

TABLE 2-1-continued

| | Initial stage | | | | After successive copying test | | | | | | |
|---|---|---|---|---|---|---|---|---|---|---|---|
| | Vd (−V) | Vl (−V) | Vr*1 (−V) | Image evaluation | Vd (−V) | Vl (−V) | Vr*1 (−V) | Image evaluation | Scraped thickness (μm) | Number of copied sheets | Overall evaluation*** |
| 2-4 | 700 | 140 | 20 | Good | (460 | 195 | 85) | Poor | 11.4 | 9 | BC |

Note:
*1Vd: dark potential, Vl: light potential (illuminance: 3 lux.sec), Vr: remanent potential.
*2The polarity of the initial charge was charged to − (negative) in Examples 2-7 and 2-8.
Overall evaluation***
AA: No problem.
BB: White dropout occurred in the near side (lower) side of the images at the time of copying around 11 × $10^4$ sheets. The successive copying test was interrupted.
BC: White dropout occurred in the near side (lower side) of the images at the time of copying around 9 × $10^4$ sheets. The successive copying test was interrupted.
CC: White dropout occurred in the near side (lower side) of the images at the time of copying around 6 × $10^4$ sheets. The successive copying test was interrupted.
DD: Black streaks occurred at the time of copying about 1000 sheets. Fog became intensive at the time of copying about 1000 sheets. Fog became intensive at the time of copying of 2000 sheets, when the successive copying test was interrupted.

TABLE 2-2

| | Initial stage | | | | After successive copying test | | | | | | |
|---|---|---|---|---|---|---|---|---|---|---|---|
| | Vd (−V) | Vl (−V) | Vr*1 (−V) | Image evaluation | Vd (−V) | Vl (−V) | Vr*1 (−V) | Image evaluation | Scraped thickness (μm) | Number of copied sheets | Overall evaluation*** |
| Ex. | | | | | | | | | | | |
| 2-11 | 700 | 125 | 10 | Good | 705 | 130 | 15 | Good | 0.2 | 60 | No problem |
| 2-12 | 700 | 115 | 10 | Good | 700 | 125 | 15 | Good | 0.3 | 60 | " |
| 2-13 | 710 | 120 | 15 | Good | 690 | 130 | 20 | Good | 0.2 | 60 | " |
| 2-14 | 700 | 125 | 15 | Good | 695 | 135 | 20 | Good | 0.6 | 60 | " |
| 2-15 | 705 | 120 | 10 | Good | 705 | 125 | 15 | Good | 0.5 | 60 | " |
| 2-16 | −700 | −130 | −20 | Good | −680 | −140 | −25 | Good | 0.2 | 60 | " |
| 2-17 | −710 | −145 | −30 | Good | −725 | −155 | −30 | Good | 0.3 | 60 | " |
| 2-18 | 710 | 135 | 20 | Good | 710 | 140 | 25 | Good | 0.5 | 60 | " |
| 2-19 | 700 | 120 | 15 | Good | 700 | 130 | 15 | Good | 0.5 | 60 | " |
| 2-20 | 700 | 110 | 0 | Good | 700 | 115 | 5 | Good | 0.3 | 60 | " |
| 2-21*3 | 690 | 100 | 5 | Good | 695 | 180 | 70 | Good | <0.1 | 10 | " |
| 2-22*3 | 700 | 105 | 0 | Good | 700 | 110 | 5 | Good | <0.1 | 10 | " |

Notes
*1The same as in Table 2-1.
*2The polarity of the initial charge was changed to − (negative) in Examples 2-16 and 2-17.
*3The test for Examples 2-21 and 2-22 was performed in the environment of a temperature of 30° C. and a relative humidity of 85%.

What is claimed is:

1. An image-bearing member having a surface layer comprising a crystalline polyester resin having a melting point of 160° C. or higher and a cured resin.

2. An image-bearing member according to claim 1, wherein 3–50 wt. parts of the cured resin is contained per 100 wt. parts of the high-melting point polyester resin.

3. An image-bearing member according to claim 1, wherein said high-melting point polyester resin comprises polyethylene terephthalate resin.

4. An image-bearing member according to claim 1, wherein said high-melting point polyester resin comprises polybutylene terephthalate resin.

5. An image-bearing member according to claim 1, wherein said high-melting point polyester resin comprises polycyclohexanedimethylene terephthalate resin.

6. An image-bearing member according to claim 1, wherein said high-melting point polyester resin comprises polyethylene naphthalate resin.

7. An image-bearing member according to claim 1, wherein said cured resin comprises photoionically cured epoxy resin.

8. An image-bearing member according to claim 1, wherein said surface layer is a protective layer.

9. An image-bearing member according to claim 8, wherein said protective layer has a thickness of 3.0 microns or less.

10. An image-bearing member according to claim 8, which comprises at least the protective layer and a photoconductive layer.

11. An image-bearing member according to claim 10, wherein said photoconductive layer comprises an organic photoconductive layer.

12. An image-bearing member according to claim 11, wherein said organic photoconductive layer is in the form of a laminate comprising a charge generation layer and a charge transport layer.

13. An image-bearing member according to claim 2, which comprises the surface layer functioning as a protective layer, and also an organic photoconductive layer.

14. An image-bearing member according to claim 1, wherein said surface layer is an organic photoconductive layer.

15. An image-bearing member according to claim 14, wherein said organic photoconductive layer is a charge transport layer.

16. An image-bearing member according to claim 14, wherein said organic photoconductive layer is a charge generation layer.

17. A process for producing an image-bearing member having a surface layer comprising: forming the surface layer by applying a coating liquid comprising a crystalline polyester resin having a melting point of 160° C. or higher and a photocurable resin uniformly dissolved in a solvent to said image-bearing member and photocuring the applied coating liquid.

18. A process according to claim 17, wherein said photocurable resin comprises epoxy resin.

19. A process according to claim 17, wherein said coating liquid contains a photopolymerization initiator which liberates a Lewis acid on light exposure.

20. A process according to claim 17, wherein said solvent comprises a fluorine-containing alcohol.

21. An apparatus comprising: an image-bearing member having a surface layer comprising a crystalline polyester resin having a melting point of 160° C. or higher and a cured resin and at least one of a charging means, a developing means and a cleaning means integrally supported with the image-bearing member to form a single unit, which said unit can be connected to or released from an apparatus body as desired.

22. An apparatus unit according to claim 21, wherein said surface layer is a layer selected from a protective layer and an organic photoconductive layer.

23. An electrophotographic apparatus comprising: an image-bearing member having a surface layer comprising a crystalline polyester resin having a melting point of 160° C. or higher and a cured resin, a means for forming a latent image, a means for developing the latent image and a means for transferring the developed image onto a transfer-receiving member.

24. A facsimile apparatus comprising: an electrophotographic apparatus and a receiving means for receiving image data from a remote terminal, wherein said electrophotographic apparatus comprises an image-bearing member having a surface layer comprising a crystalline polyester resin having a melting point of 160° C. or higher and a cured resin, a means for forming a latent image, a means for developing the latent image and a means for transferring the developed image onto a transfer-receiving member.

* * * * *

UNITED STATES PATENT AND TRADEMARK OFFICE

CERTIFICATE OF CORRECTION

PATENT NO. : 5,258,252

DATED : November 2, 1993

INVENTOR(S) : KIYOSHI SAKAI, ET AL.

It is certified that error appears in the above-identified patent and that said Letters Patent is hereby corrected as shown below:

ON TITLE PAGE

In [73] Assignees, "Tokyo, Japan" should read --both of Tokyo, Japan--.

In [57] Abstract, Line 5, "shows" should read --showing--.

IN THE DRAWINGS

Sheet 3 of 3, FIG. 8, "TRANSHITTER" should read --TRANSMITTER--.

COLUMN 1

Line 42, "representative" should read --representative example--.

COLUMN 2

Line 23, "than" should read --than separately--.
Line 29, "at a time" should read --at one time--.
Line 61, "of" should read --to have--.

COLUMN 3

Line 31, "in case" should read --in the case--.
Line 52, "resistance, how-" should read --resistance. How- --.

COLUMN 4

Line 66, "lows" should read --low--.

UNITED STATES PATENT AND TRADEMARK OFFICE

CERTIFICATE OF CORRECTION

PATENT NO. : 5,258,252

DATED : November 2, 1993

INVENTOR(S) : KIYOSHI SAKAI, ET AL.

It is certified that error appears in the above-identified patent and that said Letters Patent is hereby corrected as shown below:

COLUMN 6

Line 53, "cite" should read --site--.
Line 54, "cite" should read --site--.

COLUMN 7

Line 33, "Epikote" should read --Epikote 190P--.
Line 65, "initiators" should read --initiator--.

COLUMN 9

Formula (III), "$](R^6)_i(R^7)_d(R^8)_kY]_1+[MQ_m]^{-(m-n)}$" should read --$[(R^6)_i(R^7)_j(R^8)_kY]_1+[MQ_m]^{-(m-n)}$--.
Line 45, "structure" should read --structure;--.

COLUMN 11

Line 3, "chloroform" should read --chloroform,--.

COLUMN 12

Line 9, "electroconduc-" should read --electro-conduc- --.
Line 35, "squarilium" should read --Squarilium--.

COLUMN 13

Line 14, "substance" should read --substances--.

COLUMN 15

Line 57, "described" should read --is described--.

UNITED STATES PATENT AND TRADEMARK OFFICE

CERTIFICATE OF CORRECTION

PATENT NO. : 5,258,252

DATED : November 2, 1993

INVENTOR(S) : KIYOSHI SAKAI, ET AL.

It is certified that error appears in the above-identified patent and that said Letters Patent is hereby corrected as shown below:

COLUMN 21

Line 12, "test" should read --tested--.
Line 16, "result" should read --results--.
TABLE 1-1, "*1Vd:" should read --*1:Vd:-- and
"*2The" should read --*2:The--

COLUMN 23

TABLE 1-2, "*1The" should read --*1:The--;
"*2The" should read --*2:The--; and
"*3The" should read --*3:The--.

COLUMN 25

Line 63, "show" should read --shown--.

COLUMN 31

TABLE 2-1-continued, "*1Vd:" should read --*1:Vd:-- and
"*2The" should read --*2:The--

TABLE 2-1-continued, "Fog became intensive at the time of copying about 1000 sheets." should be deleted.

TABLE 2-2, "*1The" should read --*1:The--;
"*2The" should read --*2:The--; and
"*3The" should read --*3:The--.

COLUMN 32

Line 44, "claim 2," should read --claim 1,--.

UNITED STATES PATENT AND TRADEMARK OFFICE

CERTIFICATE OF CORRECTION

PATENT NO. : 5,258,252

DATED : November 2, 1993

INVENTOR(S) : KIYOSHI SAKAI, ET AL.

It is certified that error appears in the above-identified patent and that said Letters Patent is hereby corrected as shown below:

COLUMN 33

Line 3, "apparatus" should read --apparatus unit--.

Signed and Sealed this

Sixteenth Day of August, 1994

Bruce Lehman

*Attest:*

BRUCE LEHMAN

*Attesting Officer*

*Commissioner of Patents and Trademarks*